US006802377B2

(12) United States Patent
Foltz

(10) Patent No.: US 6,802,377 B2
(45) Date of Patent: Oct. 12, 2004

(54) HAMMER MOUNTING APPARATUS

(76) Inventor: Mark S. Foltz, 1580 Lake Grove, Petoskey, MI (US) 49770

( * ) Notice: Subject to any disclaimer, the term of this patent is extended or adjusted under 35 U.S.C. 154(b) by 0 days.

(21) Appl. No.: 10/649,248

(22) Filed: Aug. 26, 2003

(65) Prior Publication Data

US 2004/0040726 A1 Mar. 4, 2004

Related U.S. Application Data

(60) Provisional application No. 60/406,944, filed on Aug. 28, 2002.

(51) Int. Cl.[7] ..... E21B 7/00

(52) U.S. Cl. ..... 173/1; 173/90; 173/132

(58) Field of Search ..... 173/1, 18, 31, 173/42, 50, 90, 132, 193; 175/162

(56) References Cited

U.S. PATENT DOCUMENTS 3,520,374 A * 7/1970 Ebert ..... 173/185
3,584,816 A * 6/1971 Salkeld ..... 173/44
3,627,064 A * 12/1971 Sjoberg et al. ..... 173/24
3,757,875 A * 9/1973 Gunning ..... 173/44
4,087,010 A * 5/1978 Stormon ..... 414/722
4,809,788 A * 3/1989 Nelson ..... 173/28
4,889,192 A * 12/1989 Ricard ..... 173/185
5,437,341 A * 8/1995 Horn et al. ..... 175/122

* cited by examiner

*Primary Examiner*—Stephen F. Gerrity
*Assistant Examiner*—Nathaniel Chukwurah
(74) *Attorney, Agent, or Firm*—Fildes & Outland, P.C.

(57) ABSTRACT

A hammer mounting apparatus includes a main frame having a front face and a rear face. A slide assembly is connected to the front face of the main frame. The slide assembly includes two elongated guides having an upper and lower end, stops, two elongated followers shorter in length than the guides and a slide. Each guide is bordered on its upper and lower end by a stop, the guides are positioned about the followers and the followers are rigidly connected to the slide. A tool mounting clamp is connected to a face of the slide of the slide assembly. A mounting flange is connected to the rear face of the main frame. Two tool handle mounts are also connected to the main frame.

5 Claims, 4 Drawing Sheets

HAMMER MOUNTING APPARATUS

CROSS REFERENCE TO RELATED APPLICATION

This application claims the benefit of U.S. Provisional Application No. 60/406,944, filed Aug. 28, 2002.

TECHNICAL FIELD

This invention relates to apparatus for mounting a pneumatic hammer to equipment and more particularly to a mounting arrangement for mounting a hand-held type hammer for breaking apart surface materials such as ceramic tiles and marble from a supporting surface.

BACKGROUND OF THE INVENTION

It is known in the art relating to the removal of hard floor surfaces such as tile and marble from a supporting surface to use a hand-held pneumatic hammer. The process of removal is arduous for the hammer operator. Therefore, mounting apparatus have been developed and implemented to attach such hand-held type hammers to equipment such as a backhoe, skid loader, or other machinery. Using these conventional attachment devices, the hammer is rigidly held in place on the attachment. Such arrangements do not allow for the dissipation of unwanted vibrations of the hammer nor do they allow the hammer body to have longitudinal freedom. This can subsequently lead to damage of the supporting surface, usually cement. This is undesirable because it then requires that the surface structure be repaired or replaced before a new floor can be laid.

SUMMARY OF THE INVENTION

The present invention provides for the mounting of a pneumatic hammer to an apparatus that allows the hammer body to move freely in an up and down, longitudinal direction within a fixed range. In this way, during operation, the hammer can slide in a direction parallel to its line of impact, thus reducing the force of impact for a more controlled breaking of the surface. The invention thus allows the operator to break apart surface material while leaving the underlying supporting surface unaltered.

More specifically, a mounting apparatus in accordance with the invention includes a main frame and a slide assembly connected to the main frame. The slide assembly includes a fixed portion and a slide portion. A tool mounting clamp is connected to the slide portion of the slide assembly and allows for a tool to be attached to the slide assembly. Tool handle mounts, connected to the main frame, allow for attachment of the tool handles to the main frame to further support the tool on the mounting apparatus. The slide portion of the slide assembly can travel up and down along the vertical axis of the main frame within a range restricted by upper and lower stops of the fixed portion of the slide assembly.

A mounting flange, connected to the main frame, allows the entire mounting apparatus to be adaptably connected to a piece of machinery such as a loader. The mounting flange can be attached to a skid loader mount which allows the mounting apparatus to be connected to the front end of a skid loader.

In one embodiment of the invention, a hammer mounting apparatus includes a main frame having a front face and a rear face. A slide assembly is connected to the front face of the main frame. The slide assembly includes two elongated guides, each of which are bordered on its upper and lower end by a stop. The slide assembly further includes two elongated followers which are shorter in length than the guides. The slide assembly also includes a slide, the slide being connected to the followers and the guides being positioned inside the followers.

The construction of the slide assembly allows the slide to move freely along the longitudinal axis of the main frame within the bounds of the stops. A tool mounting clamp is connected to a face of the slide of the slide assembly. A tool can be fastened to the slide via the tool mounting clamp. Further, two tool handle mounts are connected to the top of the main frame, one on each side, to mount the handles of a tool to the frame. A mounting flange is connected to the bottom end of the rear face of the main frame and allows for the attachment of the entire apparatus to any sufficient piece of machinery.

These and other features and advantages of the invention will be more fully understood from the accompanying drawings.

DETAILED DESCRIPTION OF THE INVENTION

Figure 1:
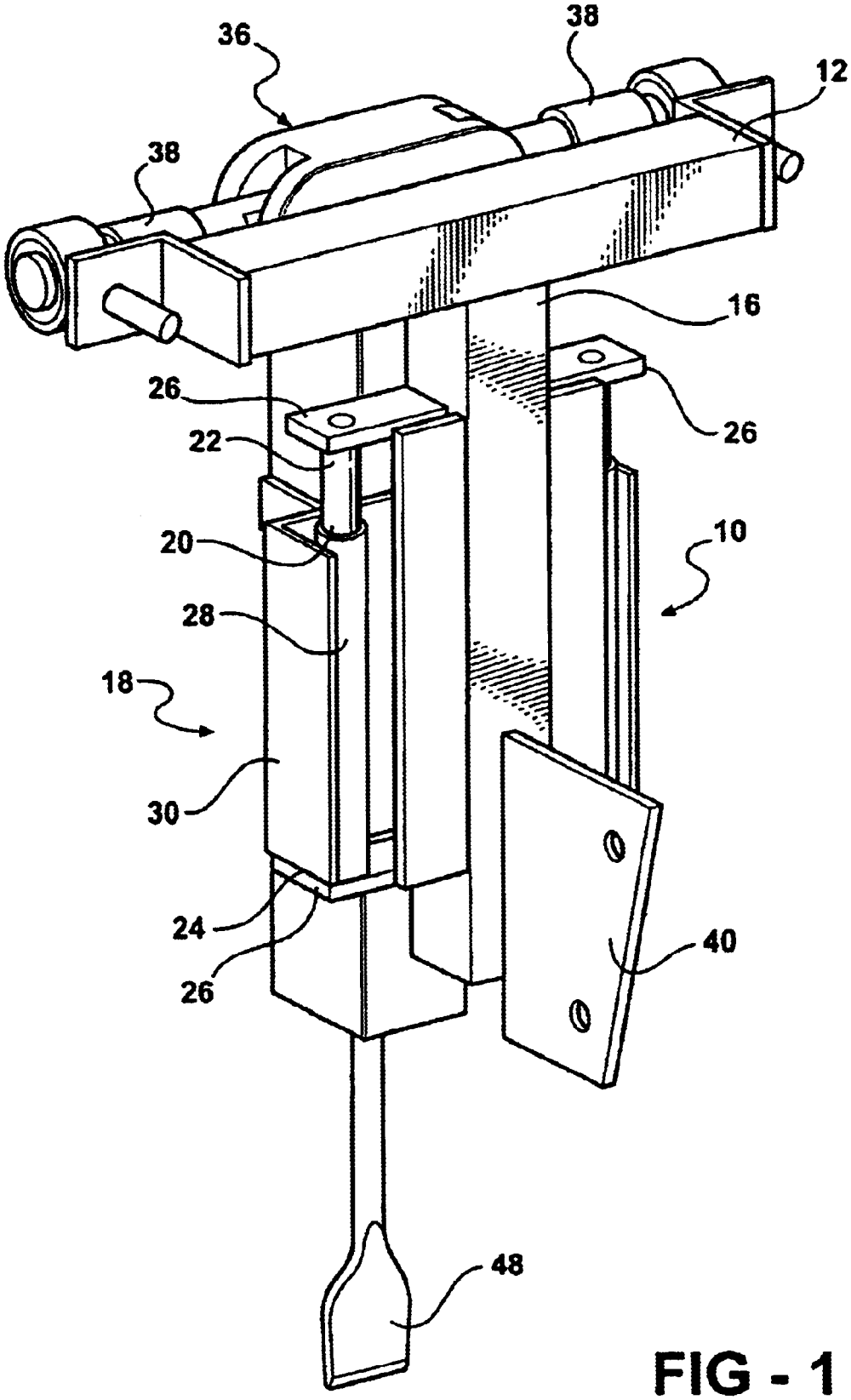
FIG. 1 is a perspective view of one side of a hammer mounting apparatus constructed in accordance with the present invention illustrating a hand held pneumatic hammer mounted thereon.

Referring now to the drawings in detail, numeral 10 generally indicates a hammer mounting apparatus in accordance with an embodiment of the present invention. As is more hereinafter fully described, the hammer mounting apparatus 10 provides for improved breaking of floor surface materials mounted on a subsurface with tools such as a pneumatic hammer.

Figure 2:
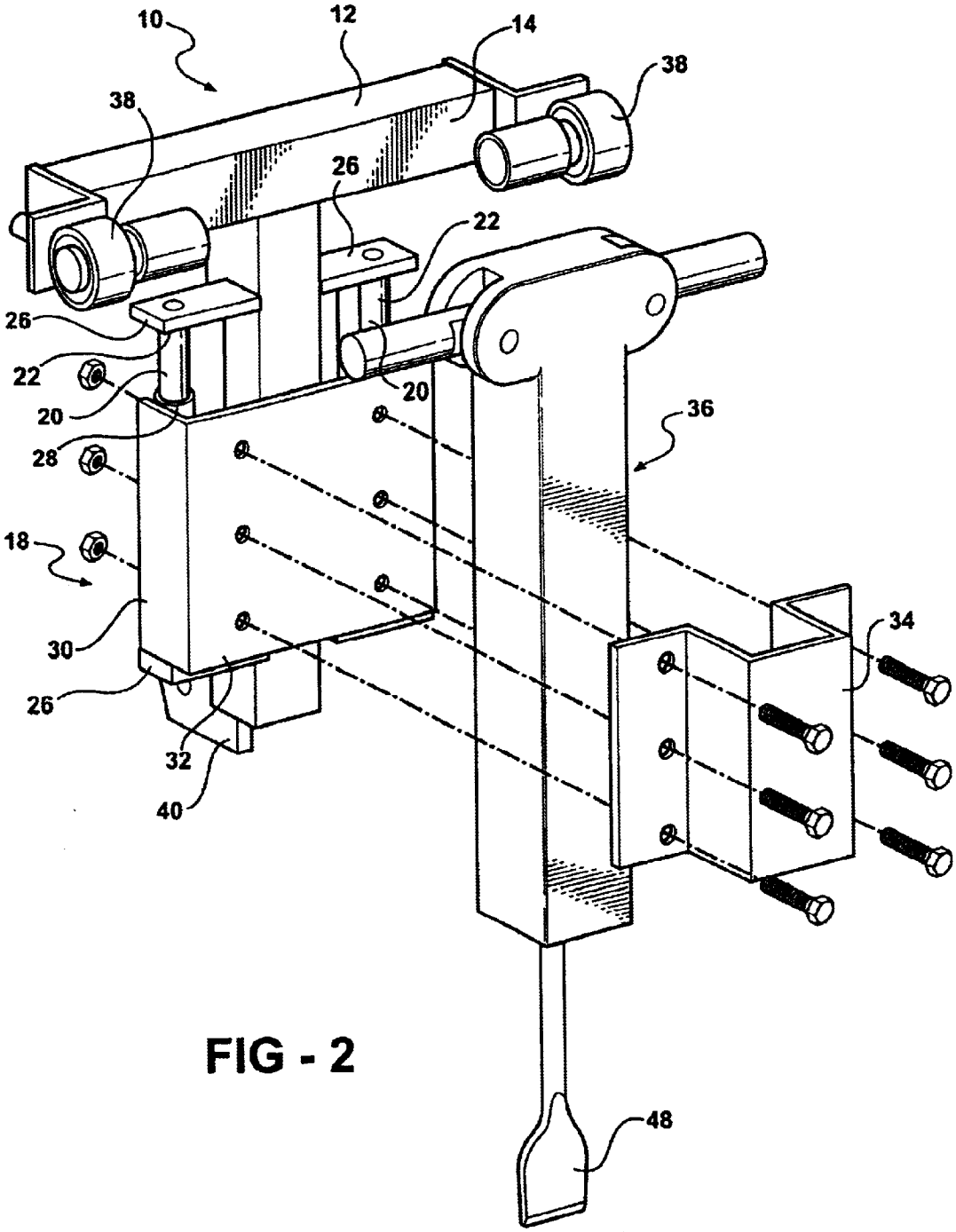
FIG. 2 is a partially exploded perspective view of the opposite side of the hammer mounting apparatus of FIG. 1 illustrating the hammer attachment.

As illustrated in FIGS. 1 and 2, a hammer mounting apparatus 10 includes a main frame 12 having a generally planer front face 14 and rear face 16. A slide assembly 18 is connected to the main frame 12 for slidably mounting a hand held type pneumatic hammer thereon. The slide assembly 18 includes two elongated guides 20 having an upper end 22 and a lower end 24 and stops 26 located at each guide upper end 22 and guide lower end 24. The slide assembly 18 further includes two elongated followers 28 and a slide 30 having a generally planer slide face 32. The followers 28, which are shorter in length than the guides 20, are rigidly connected to the slide 30. The guides 20 are positioned inside of the followers 28, allowing the slide 30 to move up and down along the longitudinal axis of the main frame 12 over a distance bounded by the stops 26.

A tool mounting clamp 34 attaches to the slide face 32 and allows for the mounting of a tool such as a pneumatic hammer 36 to the hammer mounting apparatus 10. Two tool handle mounts 38, attached to the main frame 12, further secure the tool, herein a pneumatic hammer 36, to the hammer mounting apparatus 10. A mounting flange 40 extends from the rear face 16 of the main frame 12 and allows the hammer mounting apparatus 10 to be adaptably connected to a piece of machinery.

Figure 3:
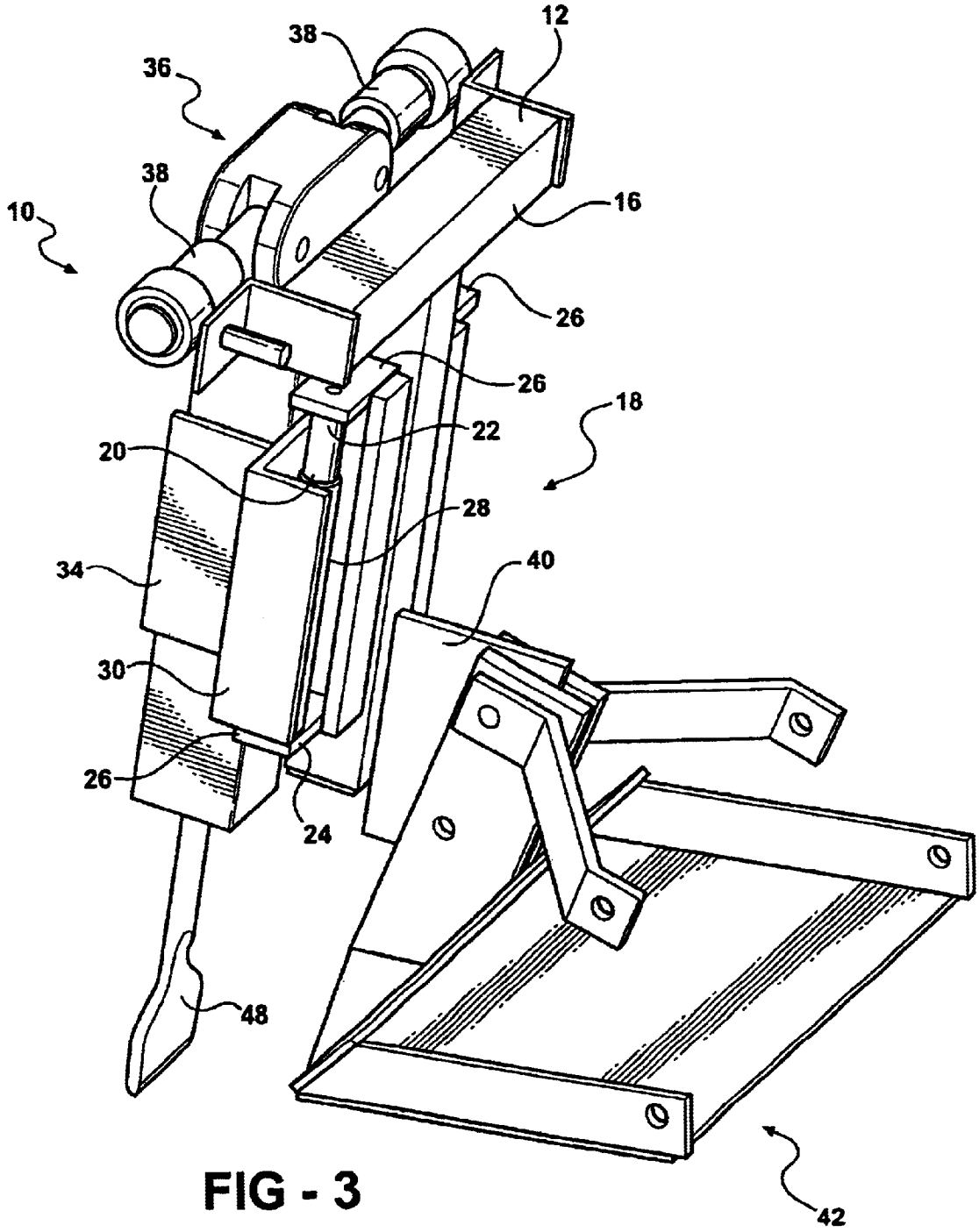
FIG. 3 is another perspective view of the hammer mounting apparatus illustrating a combination with a loader mount for mouthing the apparatus to a loader boom.
Figure 4:
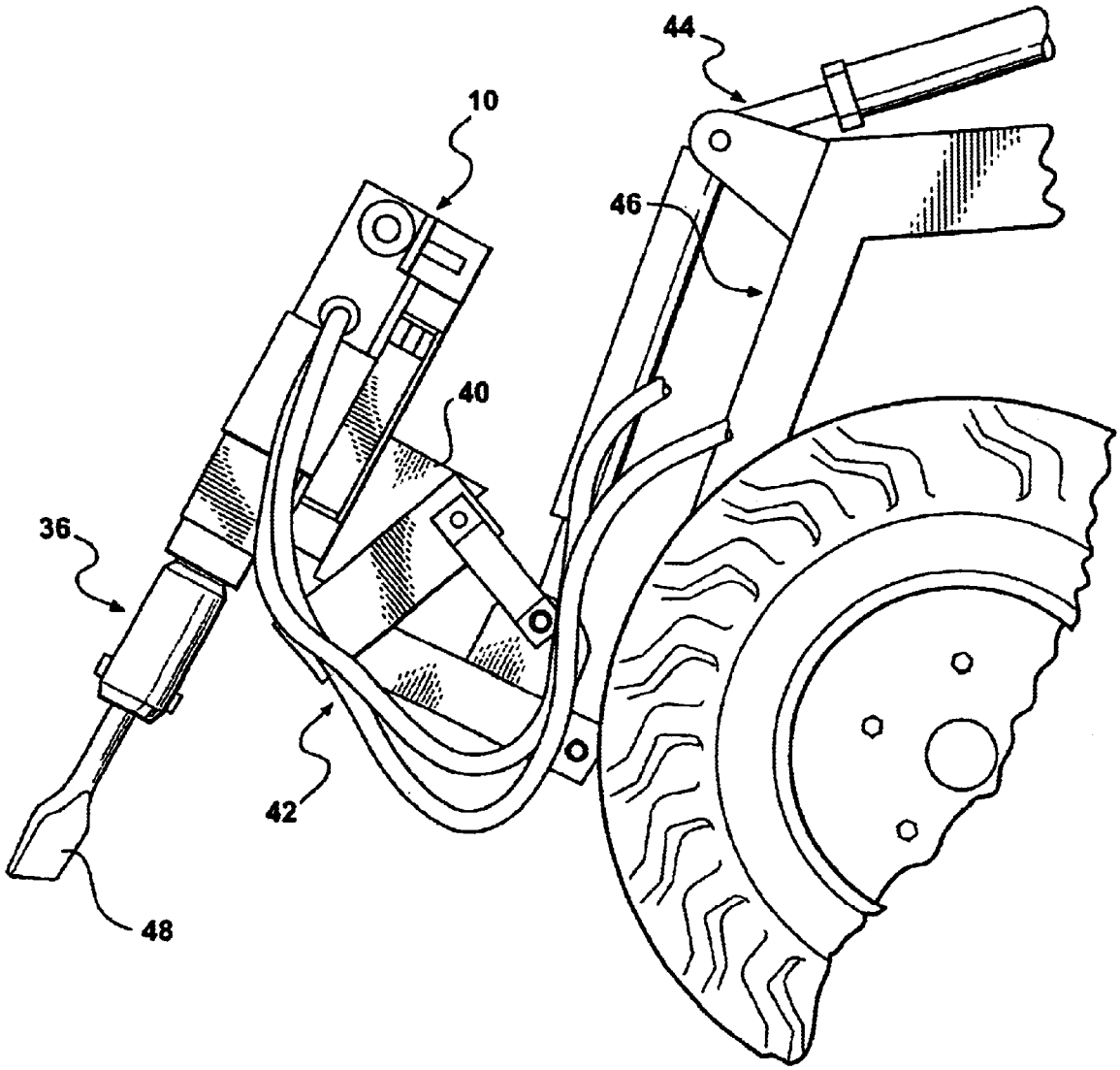
FIG. 4 is an environmental view of the hammer mounting apparatus mounted on a loader.

Referring now to FIGS. 3 and 4, the mounting flange 40 of the hammer mounting apparatus 10 can be attached to a loader mount 42. The loader mount 42 allows the hammer mounting apparatus 10 to be fastened to the boom 44 of a loader 46. With the hammer mounted on the boom 44, floor covering such as tile, marble, etc. can be easily removed.

When a tool such as a pneumatic hammer 36, being attached to the hammer mounting apparatus 10, is operated and its working end 48 applied to a hard surface such as marble, the force of impact is dissipated via the slide assembly 18. More specifically, as the working end 48 of the hammer 36 contacts the surface, the hammer body, being connected to the slide assembly 18, can slide in an up and down motion in reaction to the impact force of the hammer against the surface. The followers 28 and attached slide 30 can move along the guides 20 but are limited in their range of motion by the stops 26. The action of the hammer 36, slide 30 and followers 28 moving along the guides 20 thereby dissipate the excess impact force and control the intensity of the hammer's force on the contacted surface.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A hammer mounting apparatus, comprising:

a main frame having a front face and a rear face;

a slide assembly connected to the front face of the main frame, said slide assembly comprising two elongated guides having an upper and lower end, stops, two elongated followers shorter in length than the guides, and a slide, wherein each guide is bordered on the upper and lower end by the stops, the guides are positioned about the followers and the followers are rigidly connected to the slide;

a tool mounting clamp connected to a face of the slide of the slide assembly;

a mounting flange connected to the rear face of the main frame; and two tool handle mounts connected to the main frame.

2. The hammer mounting apparatus of claim 1, adapted to mount a pneumatic hammer.

3. The hammer mounting apparatus of claim 1, further comprising a loader mount attached to the mounting flange.

4. A method for a hammer mounting apparatus, comprising the steps of:

providing a hammer mounting apparatus comprising:

a main frame having a front face and a rear face;

a slide assembly connected to the front face of the main frame, said slide assembly comprising two elongated guides having an upper and lower end, stops, two elongated followers shorter in length than the guides, and a slide, wherein each guide is bordered on the upper and lower end by the stops, the guides are positioned about the followers and the followers are rigidly connected to the slide;

a tool mounting clamp connected to a face of the slide of the slide assembly;

a mounting flange connected to the rear face of the main frame; and two tool handle mounts connected to the main frame; and attaching a tool to the slide portion of the slide assembly.

5. The method for a hammer mounting apparatus of claim 4, further comprising the step of:

attaching the mounting flange of the hammer mounting apparatus to the boom of a piece of movable equipment.

* * * * *